US005803994A

United States Patent [19]

Coats, II et al.

[11] Patent Number: 5,803,994

[45] Date of Patent: Sep. 8, 1998

[54] ALUMINUM-COPPER ALLOY

[75] Inventors: Norman Leroy Coats, II; Larry Eugene Farrar, Jr., both of Jackson, Tenn.

[73] Assignee: Kaiser Aluminum & Chemical Corporation, Pleasanton, Calif.

[21] Appl. No.: 820,029

[22] Filed: Mar. 19, 1997

Related U.S. Application Data

[60] Continuation of Ser. No. 452,814, May 30, 1995, abandoned, which is a division of Ser. No. 151,681, Nov. 15, 1993.

[51] Int. Cl.[6] ..... C22C 21/12

[52] U.S. Cl. ..... 148/416; 420/530; 420/531; 420/554

[58] Field of Search ..... 148/416, 438; 420/530, 531, 540, 554

[56] References Cited

U.S. PATENT DOCUMENTS

| | | | |
|---|---|---|---|
| 2,026,575 | 1/1936 | Kempf et al. | 420/530 |
| 2,026,576 | 1/1936 | Kempf et al. | 420/530 |
| 2,076,571 | 4/1937 | Kempf et al. | 420/530 |
| 5,122,208 | 6/1992 | Alabi | 148/440 |
| 5,194,102 | 3/1993 | Wyss | 148/699 |

FOREIGN PATENT DOCUMENTS

| | | |
|---|---|---|
| 55-094456 | 7/1980 | Japan . |
| 61-026740 | 2/1986 | Japan . |
| 61-119643 | 6/1986 | Japan . |

OTHER PUBLICATIONS

Article from vol. 31, No. 12—Jrl. Japan Inst Light Metals, Dec. 1981.

202438 84–560059, Tsuji, Y; Doi, Y, Japan Institute of Light Metals, 65th Conference, Tokyo, Japan, Nov. 1983.

*Metals Handbook: Desk Edition*; Boyer and Gall, editors; American Society for Metals, Metals Park, Ohio; 1985; pp. 6–8 to 6–11, 6–24, 6–25, 6–28, 6–30.

*Primary Examiner*—George Wyszomierski

*Attorney, Agent, or Firm*—Philip L. McGarrigle; Gerald D. Haynes

[57] ABSTRACT

An essentially lead-free aluminum alloy is provided for extruded screw machine stock. The alloy consists essentially of from about 4.5% to about 6% copper, a maximum of about 0.4% silicon, a maximum of about 0.7% iron, not more than about 0.3% zinc, from about 0.1% to about 1% bismuth, from about 0.2% to about 0.5% tin, balance aluminum and unavoidable impurities. The screw machine stock is prepared by extruding a homogenized billet to the desired shape, then the shape is subjected to a thermomechanical treatment involving at least one heat-treatment and cold working.

4 Claims, No Drawings

ALUMINUM-COPPER ALLOY

This application is a continuation, of application Ser. No. 08/452,814 filed May 30, 1995 now abandoned which is a divisional application of Ser. No. 08/151,681 pending, filed Nov. 15, 1993.

BACKGROUND OF THE INVENTION

Conventional aluminum alloys used for screw machine stock contain, among other alloying elements, lead (Pb). There is a growing health concern regarding the presence of lead in many materials, including the presence of lead in conventional aluminum alloy screw machine stock. As a result of these health concerns attempts were made to provide an aluminum alloy for screw machine stock which is not only essentially lead-free, but also exhibits physical properties that allows its ready use in lieu of the lead containing alloy. It has been found, that if the lead content of the conventional aluminum alloy screw machine stock is replaced with a substantially corresponding quantity of tin (Sn) and such Sn-containing aluminum alloy is then subjected to a thermomechanical treatment, an alloy is obtained which exhibits at least the equivalent, but in certain respects superior, physical properties to those exhibited by the Pb-containing aluminum screw machine stock alloy without encountering any significant health hazard which the prior art alloy created. The essentially lead-free aluminum alloy of the present invention contains from about 4.5 to about 6% Cu, a maximum of about 0.4% Si, a maximum of about 0.7% Fe, not more than about 0.3% Zn, from about 0.1 to about 1.0% Bi, from about 0.1 to about 0.5% Sn, balance Al and unavoidable impurities. The term "essentially lead-free", for the purposes of this invention, defines an alloy which contains lead only as an unavoidable impurity in amounts not exceeding 0.05%.

Use of tin in aluminum alloys employed for mechanical cutting operations, such as boring, drilling or lathe-cutting, has been known for many years. Thus, in U.S. Pat. No. 2,026,571 (Kempf et al) a free cutting aluminum alloy is described which contains copper, silicon and tin. The copper content of this known free cutting alloy is within the range of 3–12%, the silicon content is within the range of 0.5–2%, and the tin level is maintained within 0.005 to 0.1%. This prior art alloy may also contain 0.05 to 6% of one or more of the following elements: bismuth (Bi), thallium (Tl), cadmium (Cd) or lead (Pb). In order to improve the cutting properties of this alloy, the alloy may be subjected to a solution heat treatment and cold drawing.

Another prior art patent, U.S. Pat. No. 2,026,575 (Kempf et al), also discloses a free cutting aluminum alloy containing from about 4 to about 12% Cu, from about 0.01 to about 2% Sn, and about from about 0.05 to about 1.5% Bi. The patent mentions that to alter the physical properties of the alloy, it can be subjected to the usual heat treatments familiar to those skilled in the art of treating aluminum-copper alloys.

A more current reference, U.S. Pat. No. 5,122,208 (Alabi), discloses a wear-resistant and self-lubricating aluminum alloy which contains relatively substantial additions of tin and bismuth. This alloy has a Sn content from about 0.5 to about 3% with a corresponding quantity of Bi content. This alloy however has a very high silicon content and a very low Cu level which makes it unsuitable for use as a screw machine stock alloy. Sn and Bi-containing aluminum alloys were also employed in the manufacture of sacrificial anodes, however, the compositions of the conventional aluminum alloy sacrificial anodes make them unsuitable for use as screw machine stock.

BRIEF SUMMARY OF THE INVENTION

An essentially lead-free aluminum alloy, containing a combination of Sn and Bi, is provided for screw machine stock. The alloy consisting essentially of from about 4.5 to about 6% Cu, a maximum of about 0.4% Si, a maximum of about 0.7% Fe, not more than about 0.3% Zn, from about 0.2 to about 0.8% Bi and from about 0.1 to about 0.5% Sn, balance aluminum and unavoidable impurities. When this alloy is subjected to a thermomechanical treatment, for example a solution heat treatment followed by cold working, its physical, mechanical and machining properties are at least equivalent to the properties of the conventional lead-containing aluminum alloy screw machine stock without the attendant health hazards.

DETAILED DESCRIPTION OF THE INVENTION

This invention concerns an aluminum alloy suitable for making screw machine stock. More particularly, the invention relates to an essentially lead-free, Sn and Bi-containing aluminum alloy for screw machine stock.

Aluminum alloy screw machine stock is generally manufactured in rod or bar form for fabrication on automatic screw machines. Aluminum alloy screw machine stock must exhibit good machinability and chip breakage characteristics, as well as other satisfactory physical properties, for example high strength and hardness and satisfactory elongation. These properties were obtained in the past when a lead-containing aluminum alloy, generally having a lead content of about 0.5% and designated by the Aluminum Association as 2011 alloy, was utilized for making screw machine stock. Current concerns, regarding the harmful health effects which may be caused by prolonged exposure of screw machine operators and others to lead, have created a need for a lead-free screw machine stock alloy which performs at least in the same manner as the conventional, lead-containing 2011 aluminum screw machine stock alloy.

The aluminum alloy of the present invention provides a suitable replacement alloy for the conventional 2011 alloy without the problems created by the relatively high lead content of the conventional alloy. Also, the alloy of the present invention exhibits the required high degree of machinability and chip breakage characteristics expected of screw machine stock alloys, without sacrificing any of the essential physical and mechanical properties of the alloy.

The alloy of the invention consists of from about 4.5 to about 6% Cu, from about 0.1 to about 0.50 Sn, from about 0.2 to about 0.8% Bi, a maximum of about 0.4% Si, a maximum of about 0.7% Fe, not more than about 0.3% Zn, balance Al and unavoidable impurities. In a preferred composition, the Sn content of the alloy is maintained within the range from about 0.1 to about 0.3% with a quantity of Bi in the range from about 0.4 to about 0.7%.

The aluminum alloy of the present invention is first cast into ingots, then the ingots may be homogenized at a temperature within the range from about 900° to about 1050° F. for a time period of at least about 1 hour but not more than about 24 hours within the temperature range indicated above. Prior to extrusion the ingots are cut into billets which are heated, then extruded to a near desired rod or bar form.

To obtain the desired mechanical and physical properties, the aluminum screw machine stock alloy of the invention is subjected to a thermomechanical treatment. The thermomechanical treatment is applied to the alloy to dissolve the soluble components of the alloy. The thermomechanical treatment employed for imparting the desired properties includes at least solution heat treatment followed by cold working. Solution heat treatment of the aluminum screw machine stock alloy is generally accomplished in the temperature range from about 930° F. to about 1030° F. (448° to 555° C.). The length of the solution heat treatment applied to the aluminum alloy of the invention is generally within the range from about 0.5 to about 2 hours, preferably within the range from about 0.5 hour to about 1 hour.

Subsequent to the solution heat treatment the alloy is rapidly quenched to room temperature to minimize uncontrolled precipitation of the alloying constituents and then is subjected to a cold working step. The cold working of the alloy may involve any known cold working operation, such as drawing resulting in a 5–40% reduction in area, stress relief stretching of about 1–3% or straightening, which operations will impart to the alloy the desired T3, T4 or T451 temper.

To further improve the mechanical and physical properties of the Sn-containing screw machine stock alloy of the invention, the cold-worked alloy may be subjected to an additional heat treatment, for example a precipitation heat treatment or aging. This heat treatment is generally accomplished at a temperature within the range from about 320° to about 380° F.(160° to 193° C.) for a time period from about 2 to about 12 hours to impart a T6, T651 or T8 temper to the screw machine stock and thus further improved physical properties.

In the following Example, a comparison is provided between the physical and the mechanical properties of the Sn-containing aluminum screw machine stock alloy of the invention and the conventional, lead-containing 2011 alloy.

EXAMPLE

An aluminum alloy, containing 5.25% Cu, 0.2% Sn, 0.55% Bi, 0.04% Si, 0.43% Fe and 0.005% Zn, balance Al and unavoidable impurities (all percentages are given in weight percent and are based on the total weight of the alloy), was cast into a billet having a diameter of 9 ⅝ inches (24.45 cm). The billet was at first homogenized within a temperature range from about 900° F. to about 1050° F. (482°–565° C.) for a time period of about 2 hours then the homogenized billet was cooled and extruded into rod form. The rods were solution heat treated at a temperature within the range from about 930° to about 1030° F. (448° to about 555° C.) for a time period of about 30 minutes. The solution heat treated rods were then rapidly quenched to room temperature, cold drawn to obtain T3 temper and cut to the desired size of 144 inches length. The screw machine stock so obtained was then compared to a commercially available 2011-T3 aluminum alloy screw machine stock having a composition similar to that of the alloy of the invention with the exception that instead of Sn it contained 0.5% Pb. The results of the comparison are provided in the Table.

TABLE

COMPARISON OF THE PHYSICAL AND MECHANICAL PROPERTIES OF ALUMINUM SCREW MACHINE STOCK ALLOYS

| PROPERTIES | Sn-contg. Alloy | Pb-contg. Alloy |
|---|---|---|
| Ultimate Strength KSI | 51 | 55 |
| Yield Strength KSI | 45 | 44 |
| Elongation % | 14 | 14 |
| Hardness (Rockwell) | 111 | 112 |
| Surface RMS* | 40–50 | 40–50 |
| Tool Wear (inch)* | 0.009 | 0.011 |

*Data taken after 15 hours of machining time

From the Table it can be readily observed that the novel screw machine stock alloy performed in an equivalent manner in comparison to the conventional Pb-containing aluminum screw machine stock alloy.

Further improvements were observed in the mechanical and physical properties of the novel aluminum screw machine stock alloy when the alloy was, after cold working, precipitation heat treated. Such improvements were observed in the hardness of the alloy.

What is claimed is:

1. An essentially lead-free, extruded and then solution heat-treated aluminum screw machine stock alloy consisting essentially of from about 4.5% to 6.0% copper, a maximum of about 0.4% silicon, a maximum of about 0.7% iron, not more than about 0.3% zinc, from about 0.1% to 1.0% bismuth, from about 0.2% to 0.5% tin, balance aluminum and unavoidable impurities.

2. An alloy according to claim 1 wherein after extrusion and solution heat-treatment the alloy has been subjected to precipitation heat treatment to impart T6, T651 or T8 temper to the alloy.

3. An alloy in accordance with claim 1 wherein the tin content of the alloy is between 0.2% and 0.4%.

4. An alloy in accordance with claim 1 wherein the tin content of the alloy is between 0.2% and 0.3%.

* * * * *